United States Patent [19]

Beaumont

[11] Patent Number: 5,016,296

[45] Date of Patent: May 21, 1991

[54] AUXILIARY DRAIN AND FILLER DEVICE FOR PLASTIC POOLS

[76] Inventor: M. William Beaumont, P.O. Box 435, Chico, Calif. 95927

[21] Appl. No.: 465,934

[22] Filed: Jan. 16, 1990

[51] Int. Cl.[5] ..... E04H 4/00

[52] U.S. Cl. ..... 4/507; 4/496

[58] Field of Search ..... 4/507, 650, 191, 195, 4/196, 206, 208, 599, 600, 602, 614, 203, 496, 499, 506, 507, 518; 251/144; 285/200, 206, 161

[56] References Cited

U.S. PATENT DOCUMENTS

| | | | |
|---|---|---|---|
| 1,049,714 | 1/1913 | Herscovitz | 4/599 |
| 1,127,483 | 2/1915 | Meinecke | 285/206 |
| 1,737,981 | 12/1929 | Smith | 251/144 |
| 2,437,968 | 3/1947 | Palotsee | 68/184 |
| 3,774,418 | 1/1973 | Ohmann | 68/208 |

FOREIGN PATENT DOCUMENTS

| | | | |
|---|---|---|---|
| 187072 | 10/1922 | United Kingdom | 285/206 |

*Primary Examiner*—Henry J. Recla
*Assistant Examiner*—David J. Walczak

[57] ABSTRACT

A drain and filler attachment for a plastic pool has at one end of a threaded elbow, a threaded nipple intrudes into a plastic pool through X-cuts made in the pool material. The opening is sealed by O-rings and a threaded open cap compressing the O-rings and the pool material against a collar on the threaded elbow. At the other end, the threaded elbow has a coupling and a hose adapter. The hose adapter has a controllable water flow on and off valve at one end and a fitting at the other end for removable attachment to a cooperative fitting on a garden hose.

1 Claim, 3 Drawing Sheets

AUXILIARY DRAIN AND FILLER DEVICE FOR PLASTIC POOLS

BACKGROUND OF THE INVENTION

1. Field of the Invention

This invention relates to draining and filling devices for plastic pools. The present invention is particularly directed towards an auxiliary attachment useful with a play pool for draining the play pool without bailing or dumping out the water. The device of the present invention can be reversely used also to fill the pool.

2. Description of the Prior Art

Although drain attachments are available for a variety of plastic pool purposes, particularly for large above-ground yard pools, these drains are usually supplied as a built-in part of the pool or as input and output tubing attached to the pumping facilities of the pool. An auxiliary tubing attachment with fittings for draining or for filling a small plastic pool such as a play pool has been neglected. The present invention is designed to provide this application.

SUMMARY OF THE INVENTION

Therefore, in practicing my invention, I have provided an auxiliary drain and filler device for plastic pools with attachment fittings so the device can be easily installed by individuals at home. With my device, simple X-cuts following a supplied pattern are cut in the side of a play pool towards the bottom. This is sufficient for attaching interlocking members of the drain. The ends of the X-cuts in the pool compress along the sides of an inserted pipe end when a threaded ring-like open cap bushing is screwed down on the inserted pipe end threads. O-rings on the pipe threads abut the plastic pool material on both sides and provide a sealing gasket when the cap bushing is screwed down tight. This effectively seals the drain opening and water can be drained out through the open cap bushing. The attachment pipe is a forty-five degree plastic pipe fitting arranged for screw-on attachment to a standard garden hose threaded connector. A shut off valve at the garden hose attachment end can be opened for draining or filling the pool or closed to retain water in the pool. The garden hose connector can be either a threaded male end or a turnable female threaded connector. So the garden hose can be used for other watering, a female turnable threaded connector is preferred. When the garden hose isn't connected for filling or draining, an end cap can be screwed onto the drain to keep dirt out of the fitting. In use, the shut off valve can be opened and water can be back-run into the pool through the hose from a house spigot. When the pool is sufficiently filled, the shut off valve can be turned and the water is retained in the pool. For draining, the hose is attached to the drain and, with the shut off valve opened, the water in the pool can be directed to a particular drain area.

Therefore, a principal object of the invention is to provide an auxiliary pool drain and pool filler fitting for plastic play pools which can easily be installed at home.

Another object of the invention is to provide an attachable drain fitting for a plastic pool which can be used to drain water from the pool or used in reverse to fill the pool with water from a house spigot.

A further object of my invention is to provide a simple drain fitting for a plastic pool having a hose attachment so drained water can be directed to a desired area.

A still further object of the invention is to provide an auxiliary plastic pool drain and filler fitting so a play pool does not have to be lifted and dumped for emptying water from the pool.

Other objects and advantages of the present invention will become understood by reading descriptions of numbered parts in the specification and comparing the described parts with similarly numbered parts illustrated in the drawings.

DESCRIPTION OF THE PREFERRED EMBODIMENTS

Figure 1:
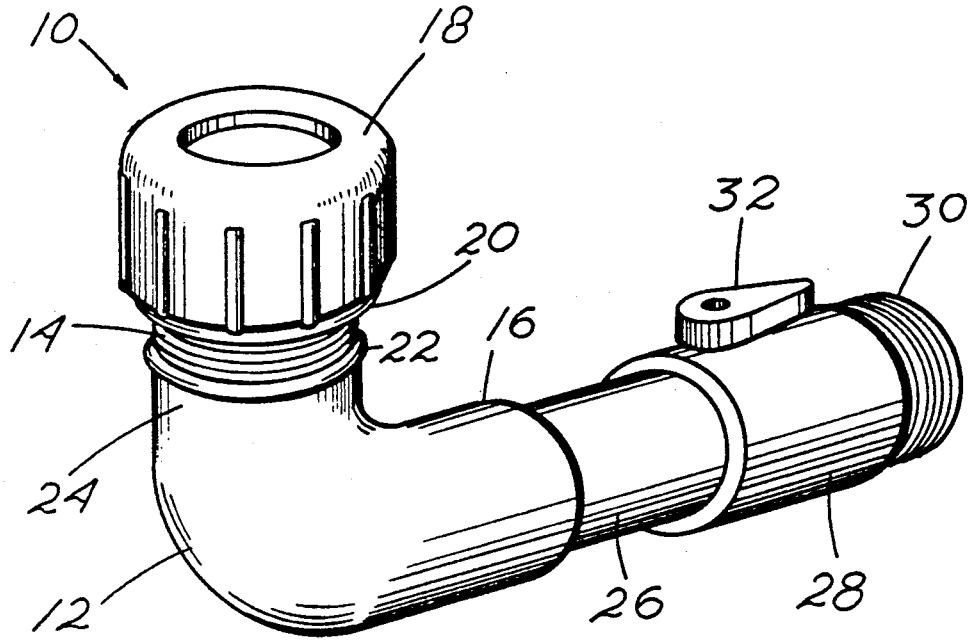
FIG. 1 is a perspective illustration of an assembled auxiliary drain and filler device for plastic pools according to the invention.

Referring now to the drawings where embodiments of the drain and filler device according to this invention are illustrated in various drawings with the device assemblage generally referred to as drain and filler device 10. In the FIG. 1 illustration, drain and filler device 10 is shown assembled in a perspective view. The main section threaded slip elbow 12 in the position illustrated has a male threaded insert end 14 vertically inclined and is right angled 90 degrees to a female threaded receiver end 16. An internally threaded open cap bushing 18 is removably attached to male threaded insert end 14 just above interior O-ring 20. Interior O-ring 20 is positioned on male threaded insert end 14 in a manner to lock down onto exterior O-ring 22 resting against elbow insert end collar 24. A coupling 26 fitting female threaded receiver end 16 attaches male hose adapter 28 to female threaded receiver end 16 of threaded slip elbow 12 completing the device structure. A shut off valve 32 operates inside of male hose adapter 28 adjacent male hose adapter threads 30 as an on and off water flow control.

Figure 2:
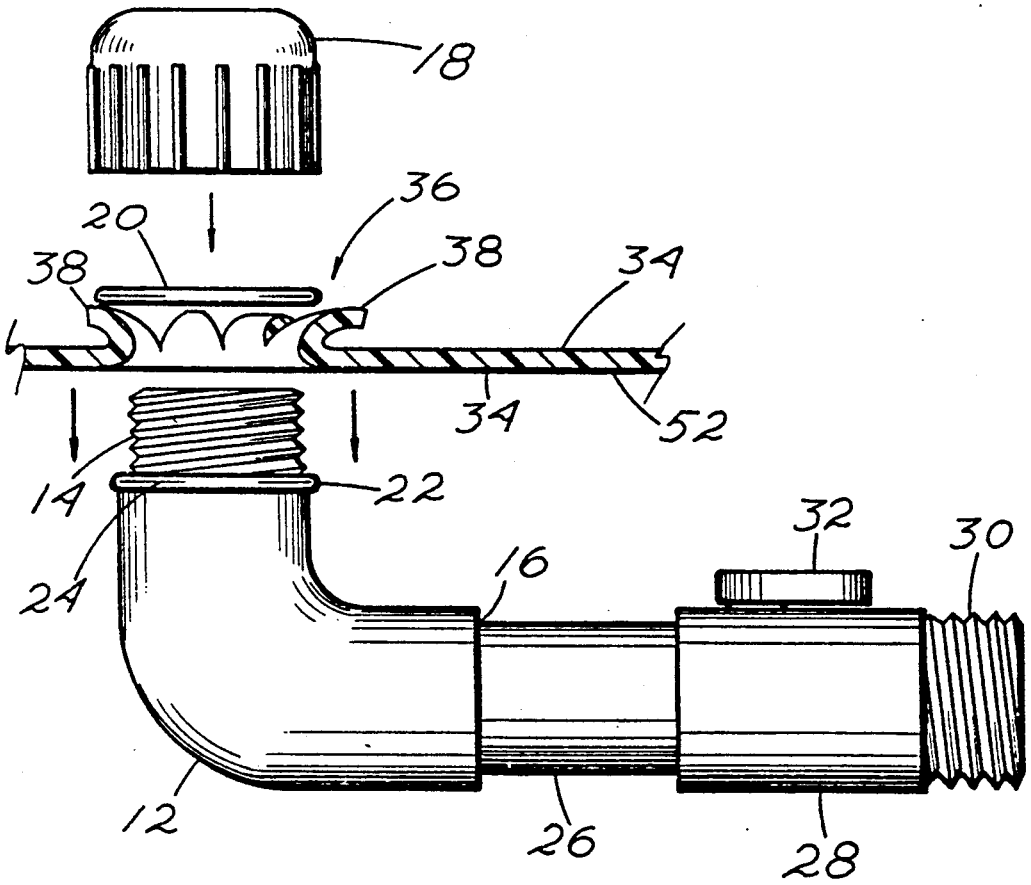
FIG. 2 is a side elevation view of the FIG. 1 embodiment with the opened cap bushing positioned above the pool insert threaded end of a threaded slip elbow. The open cap bushing is ready to be screwed down on the pool drain attachment end of the drain and filler device with the two O-rings between the cap bushing and the elbow shoulder. The shut off valve and a male hose attachment are shown attached at the hose connector end of the device.

In the FIG. 2 side view elevation of the drain and filler device 10, threaded elbow 12 with attachments coupling 26 and male hose adapter 28 installed is positioned for insertion of male threaded insert end 14 through pool material 34 via X-cut 36 in pool wall 52. X-cut material ends 38 are pulled up and laid back on the side of plastic pool wall 52 so when male threaded insert end 14 is pushed through the opening formed by X-cut 36, open cap bushing 18 can be screwed down on male threaded insert end 14 and seated against interior O-ring 20 which in turn seats against X-cut material ends 38 and pool material 34 on one side and exterior O-ring 22 on the other side of pool material 34 seated against elbow insert end collar 24.

Figure 3:
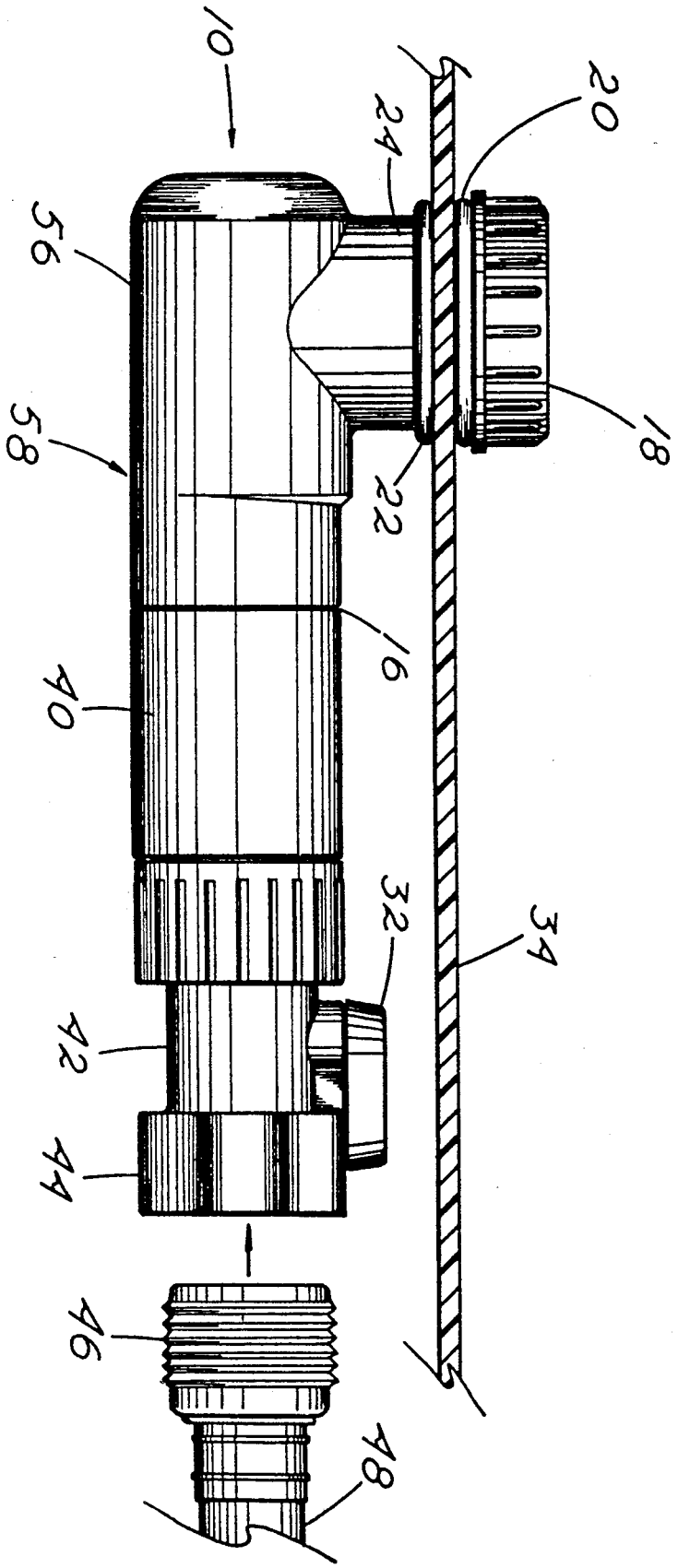
FIG. 3 shows the drain device according to the invention attached through the material of a plastic play pool. The opened cap bushing is tightened down retaining the pool material between O-rings compressed against the elbow shoulder for sealing. A female garden hose fitting is shown at the garden hose connection end of the device with the shut off valve adjacent the end of the hose fitting.

As seen in FIG. 3, X-cut material ends 38 are pressed down under interior O-ring 20 when open cap bushing 18 is screwed down and act like additional gasketing cooperative with interior O-ring 20 to effectively seal off the opening formed by X-cut 36. Also in FIG. 3, a square end threaded slip elbow 56 replaces threaded slip elbow 12 in the female adapter embodiment 58 of drain and filter device 10. In female adapter embodiment 58, the attachment between square end threaded slip elbow 56 female hose adapter 42 is sleeve coupling 40. As can be seen in the illustration at FIG. 3, shut off valve 32 is in female adapter 42 adjacent female hose receptacle 44. A garden hose 48 is shown with garden hose male connector 46 ready for screw-in connection to female hose receptacle 44.

Figure 4:
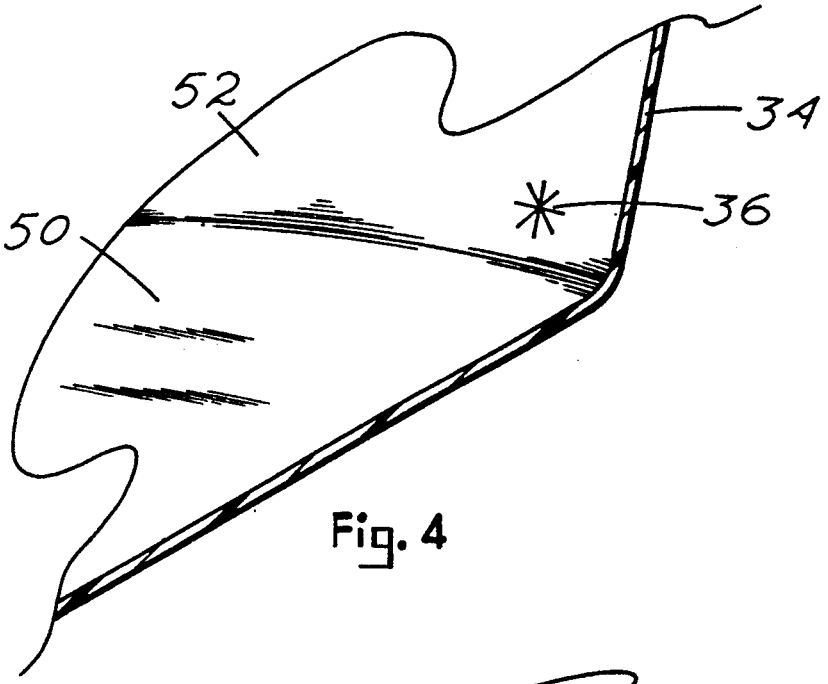
FIG. 4 shows a section of a side wall of a plastic pool with X-cuts made and the pool wall ready for insertion of the drain end.
Figure 5:
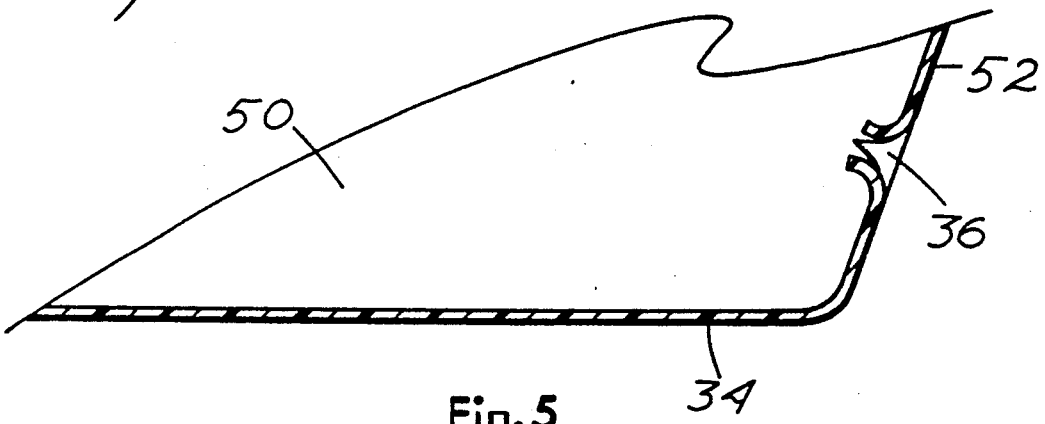
FIG. 5 is a sectional side view of FIG. 4 illustrating how the pool wall material is pressed inward for insertion of the drain pipe threaded end.
Figure 6:
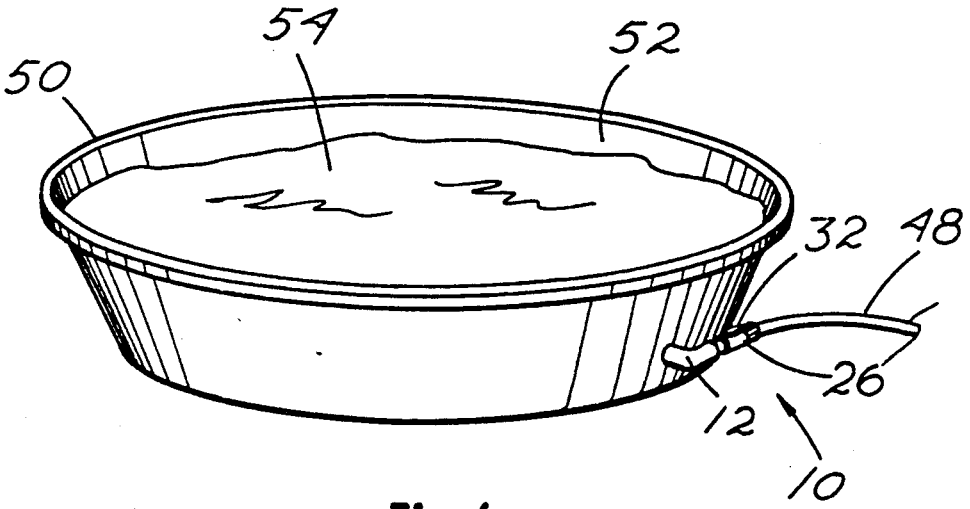
FIG. 6 shows the drain and filler device of this invention in use installed in the side of a plastic play pool.

FIG. 4 shows a partial end view of plastic play pool 50 and pool wall 52. X-cut 36 is shown marked for cutting through pool material 34 low in pool wall 52. In a sectional side view of the same area, FIG. 5 illustrates how X-cut 36 has the ends curled in after the cut is made through pool material 35 in pool wall 52. The FIG. 5 illustration shows plastic play pool 50 with drain and filter device 10 installed and plastic play pool 50 filled with water 54. To fill plastic play pool 50 without having to carry water or to run water into the pool from a garden hose, shut off valve 32 is opened and water is back flowed through garden hose 48 and through threaded slip elbow 12 directly into plastic play pool 50. When sufficient water 54 is in plastic play pool 50, shut off valve 32 is closed and water 54 is retained in the pool. To drain plastic play pool 50, normally lifted and dumped, garden hose 48 is disconnected from the house bib, if not already disconnected, and directed to where the drained water 54 is wanted. Shut off valve is then opened and water 54 is allowed to run out through drain and filler device 10 and along garden hose 48 where directed. Plastic play pool 50 might have to be lifted on one side to remove all of water 54 but with the pool mostly empty, this is not a difficult task.

Although I have described embodiments of my invention with considerable details in the specifications, I reserve the right to modify the invention to any extent which is congruent with the intended scope of the appended claims and I will consider modified similar devices which fall within my claim scope to be one and the same with my invention.

What is claimed as my invention is:

1. In combination with a plastic pool, an auxiliary drain and filler attachment comprising in combination a threaded elbow having at a first end a threaded male fixture, and at a second end there being a threaded female fixture, a shoulder surrounding said first end adjacent said threads, said threaded male fixture removably inserted into an opening cut through material of a plastic pool and removably being sealed therein, there being a cap opened at both ends removably screwed down on said elbow so as to be located on said threaded male fixture, O-rings positioned on each side of said pool material against said pool material and between said shoulder and cap on said threaded elbow, whereby said threaded elbow is sealingly affixed to said pool material, a coupling having a first end threadably connected to said second end of said threaded elbow, and a second end threadedly connected to a hose adapter, said hose adapter including a controllable water flow on and off valve and and having a fitting adapted for removable attachment to a cooperative fitting on a garden hose.

* * * * *